United States Patent [19]

Shinkai

[11] Patent Number: 5,034,717

[45] Date of Patent: Jul. 23, 1991

[54] STATIONARY ELECTROMAGNETIC INDUCTION UNIT

[75] Inventor: Hiromu Shinkai, Hyogo, Japan

[73] Assignee: Mitsubishi Denki K.K., Tokyo, Japan

[21] Appl. No.: 528,985

[22] Filed: May 25, 1990

[30] Foreign Application Priority Data

Aug. 5, 1989 [JP] Japan ..... 1-203081

[51] Int. Cl.[5] ..... H01F 27/28

[52] U.S. Cl. ..... 336/223; 336/183; 336/187; 336/232

[58] Field of Search ..... 336/232, 223, 186, 200, 336/187, 183

[56] References Cited

U.S. PATENT DOCUMENTS 1,376,011 4/1921 Frank ..... 336/223

4,313,152 1/1982 Vranken ..... 336/232 X

*Primary Examiner*—Thomas J. Kozma

*Attorney, Agent, or Firm*—Sughrue, Mion, Zinn, Macpeak & Seas

[57] ABSTRACT

In a stationary electromagnetic induction unit according to this invention, a plate-like coil is constituted by a plurality of coil elements wound in parallel. Therefore, a conductor width of the coil element becomes small, and a stray loss caused by a leakage flux vertically interlinked with the surface of the coil element, namely, the plate-like coil is reduced.

1 Claim, 3 Drawing Sheets

STATIONARY ELECTROMAGNETIC INDUCTION UNIT

BACKGROUND OF THE INVENTION

1. Field of the Invention

This invention relates to an improvement in a stationary electromagnetic induction unit such as a transformer of low voltage and high current for a rectifier or an electric furnace, for example.

2. Description of the Prior Art

FIGS. 1 and 2 show a shell type transformer (hereinafter merely referred to as a transformer) for a rectifier which is a conventional electromagnetic induction unit. FIG. 1 shows a structure of an iron core and a coil. FIG. 1(*a*) is a section in plan taken on line I*a*—I*a* of FIG. 1(*b*), and FIG. 1(*b*) is a section in side taken on line I*b*—I*b* of FIG. 1(*a*). FIG. 2 is a perspective view of a copper plate coil constituting a low voltage winding. In these figures, reference numeral 1 denotes a shell type core, and 2 a high voltage winding. Two plate-like high voltage coils 3 and 4 are connected in series (not shown). Reference numeral 5 denotes a low voltage winding, and four copper plate coils 6 to 9 are connected in parallel. Each of the copper plates coils 6 to 9 is a rectangular plate-like coil in which a bare copper plate 10 having a conductor width W is wound into an edgewise wound coil of one turn. Four copper plate coils 6 to 9 are connected in parallel by connection conductors (not shown) at connection leads 10*a* and 10*b* of each bare copper plate 10.

Each of the copper plate coils 6 to 9 has a shape in which a single copper plate 10 is wound edgewise as described above and is not divided in a direction of the conductor width W of the copper plate 10. Therefore, a large stray loss occurs due to a leakage flux vertically interlinked with the surface of the copper plate 10 (As is known, an eddy current loss is proportional to the square of the conductor width W when the magnetic flux vertically interlinks with the surface of the copper plate). This poses problems that make the efficiency of the transformer low, the capacity of the cooler large, and so on.

SUMMARY OF THE INVENTION

This invention has been accomplished in order to overcome the aforementioned problem. An object of the present invention is to provide a stationary electromagnetic induction unit which is small in stray loss and good in efficiency.

For achieving the aforesaid object, in this invention, a plate-like coil of one turn edgewise winding is composed of a plurality of coil elements wound in parallel.

The above and other objects and new features of the present invention will become more completely clear by reading the ensuing detailed description with reference to the accompanying drawings The drawings are merely for interpretation and are not to limit the scope of the present invention.

DETAILED DESCRIPTION OF THE PREFERRED EMBODIMENTS

Figure 1:
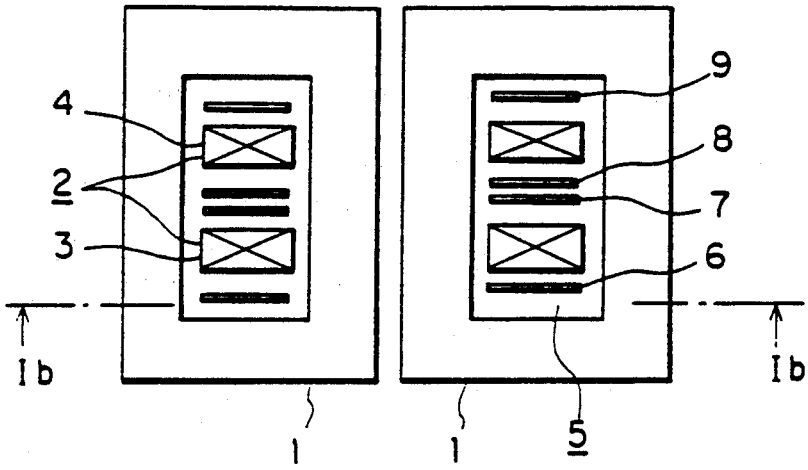
FIG. 1 (a) (PRIOR ART)
FIGS. 1(*a*) and 1(*b*) are a plan sectional view taken on line I*a*—I*a* and a side sectional view taken on line I*b*—I*b*, respectively, showing a conventional transformer.
Figure 1:
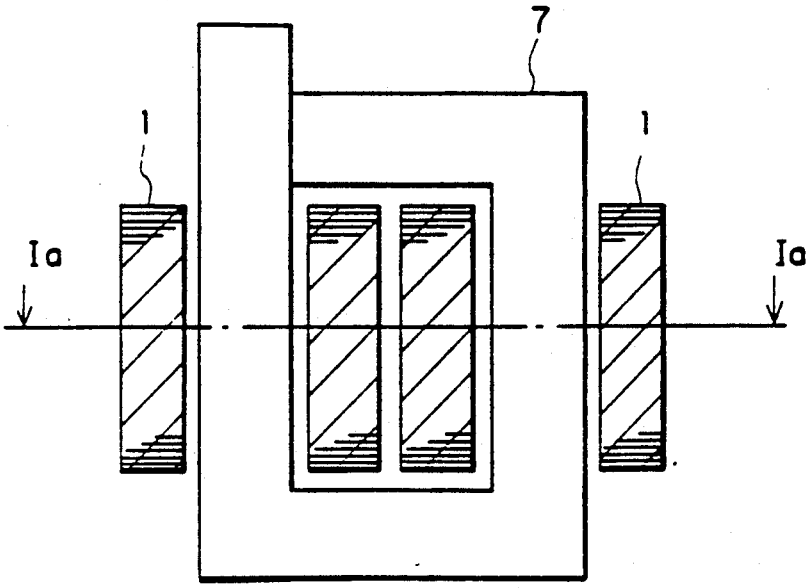
FIG. 1 (b) (PRIOR ART)
Figure 2:
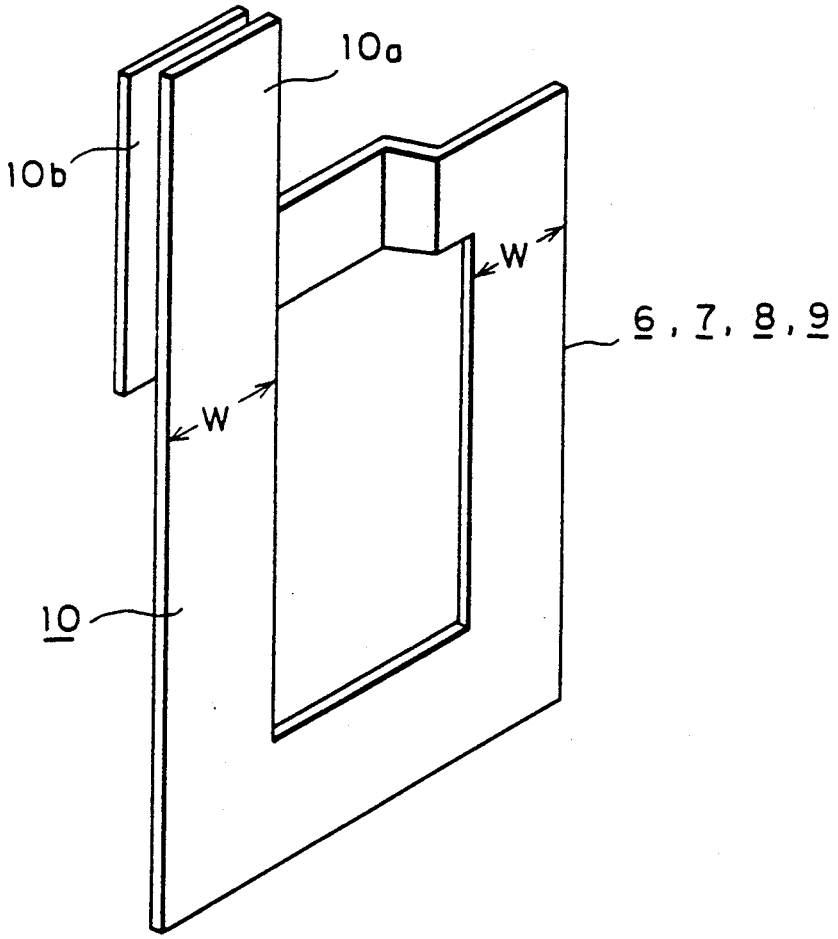
FIG. 2 (PRIOR ART)
FIG. 2 is a perspective view showing a conventional copper plate coil.
Figure 3:
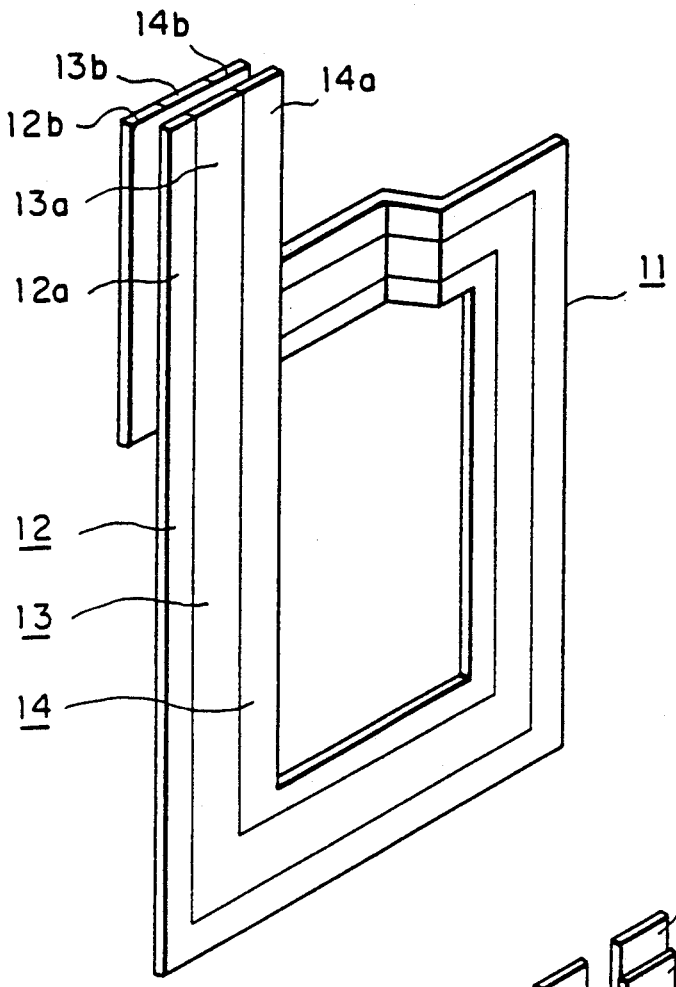
FIG. 3 is a perspective view showing a plate-like coil in one embodiment of a stationary electromagnetic induction unit according to the present invention.

FIG. 3 is a perspective view of a plate-like coil in one embodiment of a stationary electromagnetic induction unit according to the present invention. Four plate-like coils 11 in place of the copper plate coils 6 to 9 shown in FIG. 1(*a*) are used to constitute a low voltage winding 5. In FIG. 3, reference numeral 11 designates a plate-like coil, in which outer, central and inner coil elements 12, 13 and 14 are wound into single-turn coils in parallel so as to form an edgewise-wound rectangular shape similar to the conventional copper plate coil 6 shown in FIG. 2. The coil elements 12, 13 and 14 which are parallel coils are insulated from each other (not shown). The outer, central and inner coil elements 12 to 14 are connected in parallel by connection conductors (not shown) at connection leads 12*a*–14*a* and 12*b*–14*b*, and four plate-like coils 11 are connected in parallel as similar to the conventional example of FIG. 1(*a*) to constitute a low voltage winding 5. In this embodiment, since a leakage flux vertically interlinked in the vicinity of both side edges of a conductor of the plate-like coil 11 is large, a conductor width of the outer and inner coil elements 12 and 14 is made to be narrower than that of the central coil element 13 as shown in FIG. 3 in order to effectively reduce a stray loss.

Figure 4:
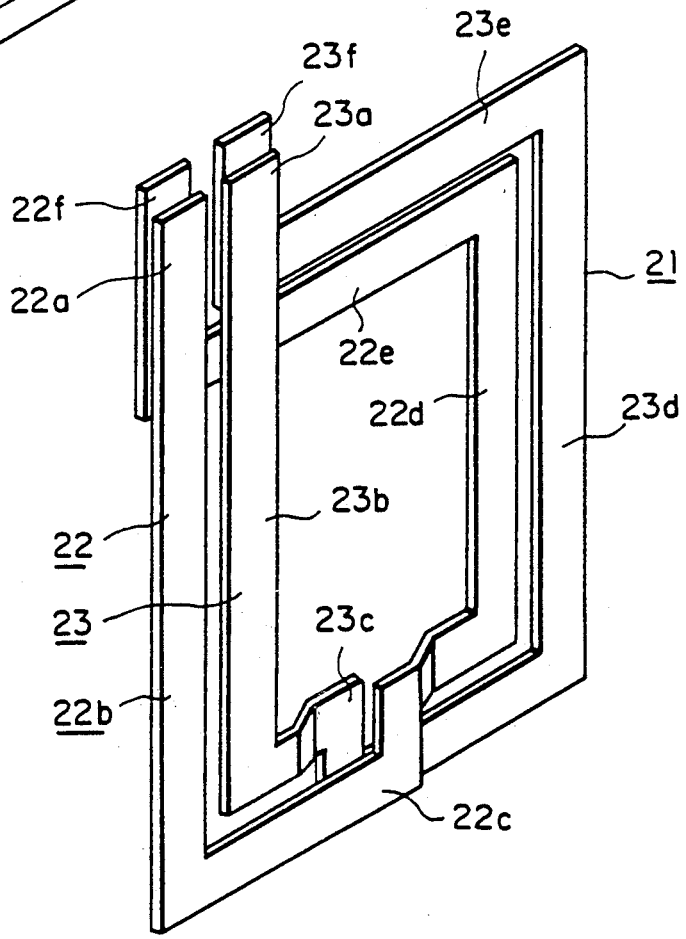
FIG. 4 is a perspective view of a plate-like coil in another embodiment of a stationary electromagnetic induction unit according to the present invention.

FIG. 4 is a perspective view showing a plate-like coil 21 in another embodiment of a stationary electromagnetic induction unit according to the present invention. Two coil elements wound in parallel to constitute a plate-like coil 21 are dislocated halfway. In FIG. 4, reference numerals 22 and 23 denote first and second coil elements, respectively, and they are insulated from each other (not shown). The coil elements 22 and 23 each form parallel-wound single-turn loops which start from front connection leads 22*a* and 23*a* through left vertical portions 22*b* and 23*b*, lower horizontal portions 22*c* and 23*c* dislocating midway, right vertical portions 22*d* and 23*d* and upper horizontal portions 22*e* and 23*e*, to rear connection portions 22*f* and 23*f*, and are connected in parallel with each other by connection conductors (not shown) between the connections 22*a* and 23*a*, and 22*f* and 23*f*.

The coil elements 22 and 23 wound in parallel are dislocated as described above whereby induced voltages of both the coils 22 and 23 are made even to reduce a current which circulates between both the coil elements 22 and 23 connected in parallel and to minimize a loss caused by the circulating current. Although in the embodiment shown in FIG. 4, dislocation has been carried out only at the lower horizontal portions 22*c* and 23*c*, it is to be noted that if dislocation is once again carried out at the upper horizontal portions 22*e* and 23*e*, the balance between both the coil elements 22 and 23 are further improved.

Further, although in the above-described embodiments, the low voltage winding has been designed so that all the plate-like coils are connected in parallel, it is to be noted that a combination of series and parallel connections may be employed as the case may be, in which case, similar effect is also obtained.

As described above, since a single-turn plate-like coil according to this invention, is constituted by a plurality of coil elements wound in parallel, a stray loss caused by a leakage flux can be reduced. A stationary electromagnetic induction unit having a good efficiency can be provided.

What is claimed is:

1. A stationary electromagnetic induction unit provided with at least one single-turn edgewise-wound plate-like coil, comprising:

a plurality of coil elements each having a uniform predetermined width, said plurality of coil elements would in parallel with one another, for forming a composite plate-like coil as said single-turn edgewise-wound plate-like coil, said plurality of coil elements being arranged such that said composite plate-like coil has at least an inner coil element, an outer coil element, and a middle coil element, wherein among the plurality of coil elements of said composite plate-like coil, the width of said inner and outer coil elements is narrower than the width of said middle coil element.

* * * * *